US005582757A

United States Patent [19]

Kio et al.

[11] Patent Number: 5,582,757

[45] Date of Patent: Dec. 10, 1996

[54] SHEET-LIKE ELECTRIC HEATER AND A SHEET-LIKE THERMAL SENSING ELEMENT USING CARBON FIBER MIXED PAPER

[75] Inventors: Koichiro Kio, Aichi-ken; Yukiko Hayashi, Osaka-fu, both of Japan

[73] Assignee: Kabushiki Kaisha Dairin Shoji, Osaka-fu, Japan

[21] Appl. No.: 210,400

[22] Filed: Mar. 18, 1994

[30] Foreign Application Priority Data

Oct. 13, 1993 [JP] Japan ..... 5-280410

[51] Int. Cl.[6] ..... H05B 3/10

[52] U.S. Cl. ..... 219/548; 338/22 R; 219/212

[58] Field of Search ..... 219/548, 497, 219/549, 547, 553, 541, 505, 203, 545, 529, 212–213; 374/163, 164, 165; 338/22, 23

[56] References Cited

U.S. PATENT DOCUMENTS

| | | | |
|---|---|---|---|
| 3,789,190 | 1/1974 | Orosy et al. | 219/497 |
| 3,839,134 | 10/1974 | Fujihara | 161/62 |
| 3,998,689 | 12/1976 | Kitago et al. | 162/136 |
| 4,149,066 | 4/1979 | Niibe | 219/505 |
| 4,629,584 | 12/1986 | Yasuda | 252/511 |
| 5,086,212 | 2/1992 | Itakura et al. | 219/505 |

*Primary Examiner*—Teresa J. Walberg
*Assistant Examiner*—Sam Paik
*Attorney, Agent, or Firm*—Lowe, Price, LeBlanc & Becker

[57] ABSTRACT

A sheet-like thermal sensing element includes a carbon fiber mixed paper and resin layers laminated on both surfaces of the carbon fiber mixed paper. Electrodes are provided along opposite two sides of the carbon fiber mixed paper. A temperature change can be detected by detecting the change of resistance value of the carbon fiber mixed paper. A sheet-like heater is also disclosed, the heater including a pair of carbon fiber mixed papers separated by an insulating sheet and surrounded by resin. Each of the carbon fiber mixed papers include electrodes thereon. The sheet like heater can both generate heat and detect temperature change for precise heating control. Also disclosed is a method of making both the sheet-like heater and sheet-like thermal sensing element involving producing the carbon fiber mixed paper, electrode formation, laminating the mixed papers together and resin encapsulation.

20 Claims, 5 Drawing Sheets

| TEMPERATURE (℃) | RESISTANCE VALUE (Ω) |
|---|---|
| 30 | 67.9 |
| 44 | 66.9 |
| 53 | 66.5 |
| 63 | 66.3 |
| 72 | 66.2 |
| 82 | 64.7 |
| 92 | 63.4 |
| 102 | 62.9 |

SHEET-LIKE ELECTRIC HEATER AND A SHEET-LIKE THERMAL SENSING ELEMENT USING CARBON FIBER MIXED PAPER

BACKGROUND OF THE INVENTION

1. Field of the Invention

The present invention relates to a sheet-like thermal sensing element, a temperature sensor, a temperature controller and a sheet-like heater.

2. Description of the Background Art

Various sheet-like heat generating elements have conventionally been developed. Especially, the sheet-like heat generating elements which use the carbon fiber mixed paper have attracted special interest recently. The temperature of such a sheet-like heat generating element depends on the position on the heat generating surface. Accordingly, temperatures in a plurality of positions on the heat generating surface must be detected when controlling the temperature of the sheet-like heat generating element. Examples of conventional temperature sensors are shown in FIG. 7, FIG. 8 and FIG. 9.

FIG. 7 shows a thermistor. This thermistor 101 includes a glass case with diameter of about 2 mm and a pair of lead wires. The thermistor 101 has excellent thermal responsiveness but it can sense the temperature in a point or a line.

FIG. 8 shows a thermal sensing wire. This thermal sensing wire 102 is made of platinum wire, nickel wire or the like of diameter about 0.1 mm. The thermal sensing wire 102 is linear in shape so that it can sense heat in a large area, but it has inferior thermal responsiveness because of its large mass.

FIG. 9 shows a thermostat. This thermostat 103 includes a package which is a rectangular prism 10 mm wide, 20 mm long and 3 mm thick, for example, and a pair of lead wires. This thermostat senses only predetermined temperature and has extremely inferior thermal responsiveness, therefore it can be used only for over-heat preventing.

The thermistor 101 shown in FIG. 7 can sense the temperature only in the point or in the line. Accordingly, a plurality of thermistors 101 must be attached to the heating surface of the sheer-like heat generating element in order to detect the temperature of the sheet-like heat generating element and control the temperature thereof. In this case, the interconnections are complex and the size of the sheet-like heat generating element will become large because of provision of the thermistors.

The thermal sensing wire 102 shown in FIG. 8 has a large mass, so that its thermal responsiveness is bad. Accordingly, it has difficulty in accurately controlling the temperature of a sheet-like heat generating element such as the carbon fiber mixed paper having very high temperature rising rate.

The thermostat 103 shown in FIG. 9 can sense the temperature only in a point similarly to the thermistor 101, so that a plurality of thermostats are needed in order to detect the temperature of the sheet-like heat generating element. Accordingly, the interconnections must be complex and the sheet-like heat generating element will be large in size.

SUMMARY OF THE INVENTION

It is an object of the present invention to provide a sheet-like thermal sensing element which can sense a temperature of a heat generating element in a plane and has excellent heat responsive property.

It is another object of the present invention to provide a temperature sensor which can detect a temperature of a heat generating element in a plane and has good thermal responsive property.

It is still another object of the present invention to provide a temperature controller which can sense a temperature of a thermal generating element and can perform temperature control with high accuracy.

It is yet another object of the present invention to provide a sheet-like heater capable of controlling the temperature with high accuracy which is thin and light.

A sheet-like thermal sensing element according to an aspect of the present invention includes carbon fiber mixed paper and electrodes provided on the carbon fiber mixed paper.

In this sheet-like thermal sensing element, a resistance value of the carbon fiber mixed paper varies depending on the temperature. Accordingly, the temperature can be detected by detecting the resistance value of the carbon fiber mixed paper through the electrodes.

The sheet-like thermal sensing element is thin and light because it is made of the carbon fiber mixed paper. Besides, it can be arbitrarily shaped, so that it can sense temperatures of surfaces of various objects. Furthermore, its thermal responsiveness is good because the mass is very small to enable temperature detection with high accuracy.

As described above, a thin and light sheet-like thermal sensing element having excellent thermal responsiveness which can detect a temperature of an object with arbitrary shape is obtained. Accordingly, it is enabled to precisely detect the temperature of surfaces of various objects.

A temperature sensor according to another aspect of the present invention includes a sheet-like thermal sensing element and detecting means. The sheet-like thermal sensing element includes Carbon fiber mixed paper, electrodes provided on the carbon fiber mixed paper and resin forming the carbon fiber mixed paper into a sheet-like form. The detecting means is connected to the electrodes to detect a resistance value of the carbon fiber mixed paper.

In this temperature sensor, the resistance value of the 5 carbon fiber mixed paper of the sheet-like thermal sensing element varies according to the temperature. Thus, the resistance value of the carbon fiber mixed paper is detected.

The sheet-like thermal sensing element is made by forming the carbon fiber mixed paper in a sheet-like shape with the resin, so that it is thin, light, and has flexibility. Accordingly, the temperatures of surfaces of objects with various shapes can be detected. Furthermore, its thermal responsiveness is good because its mass is very small to enable precise temperature detection.

As described above, a temperature sensor which is thin, light, and has flexibility and good thermal responsiveness, and can detect a temperature of an arbitrary-shaped object is obtained. Accordingly, temperatures of surfaces of various objects can be precisely detected.

A temperature controller according to still another aspect of the present invention includes a sheet-like thermal sensing element, detecting means and current adjusting means. The sheet-like thermal sensing element includes carbon fiber mixed paper and electrodes provided on the carbon fiber mixed paper. The detecting means is connected to the electrodes of the sheet-like thermal sensing element to detect a change of a resistance value of the carbon fiber mixed paper. The current adjusting means adjusts current to be supplied to the heat generating element on the basis of the change of the resistance value detected by the detecting means.

In this temperature controller, when the temperature of the heat generating element changes, the resistance value of the carbon fiber mixed paper of the sheet-like thermal sensing element changes. The change of the resistance value is detected and the current to be supplied to the heat generating element is adjusted on the basis of the detected change of the resistance value.

Since the sheet-like heat generating element is formed of the carbon fiber mixed paper, the temperature of the heat generating element can be sensed in a plane and the thermal responsiveness is good. Accordingly, the temperature of the heat generating element can be controlled with high accuracy.

As described above, a temperature controller can be obtained which is thin, light, has excellent thermal responsiveness and can be arbitrarily shaped. Accordingly, it enables accurate temperature control of surfaces of various heat generating elements.

A sheet-like heater according to still another aspect of the present invention includes a sheet-like heat generating element and a sheet-like thermal sensing element. The sheet-like heat generating element includes carbon fiber mixed paper and electrodes provided on the carbon fiber mixed paper. The sheet-like thermal sensing element includes carbon fiber mixed paper and electrodes provided on the carbon fiber mixed paper, and is laminated on the sheet-like heat generating element.

In this sheet-like heater, a resistance value of the carbon fiber mixed paper of the sheet-like thermal sensing element laminated thereon varies when the temperature of the sheet-like heat generating element changes. Accordingly, the temperature of the sheet-like heat generating element can be detected in a plane by detecting the resistance value of the carbon fiber mixed paper through the electrodes.

As the sheet-like thermal sensing element is formed of the carbon fiber mixed paper similarly to the sheet-like heat generating element, the thermal responsiveness is good and the temperature change of the sheet-like heat generating element is equal to the thermal response of the sheet-like thermal sensing element. Accordingly, precise temperature detection of the sheet-like heat generating element is enabled.

Furthermore, since the sheet-like heat generating element and the sheet-like thermal sensing element can be simultaneously produced in the same producing process, the production is easy. Also, since the sheet-like heat generating element and the sheet-like thermal sensing element are both formed of the carbon fiber mixed paper and are integrally formed, it can be thin, light and can be arbitrarily shaped.

As described above, a thin and light sheet-like heater capable of detecting the temperature of the sheet-like heat generating element can be obtained which has good thermal responsiveness and can be of arbitrary shape. Furthermore, the sheet-like heat generating element and the sheet-like thermal sensing element can be formed in the same manufacturing process, so that the production thereof is easy.

A sheet-like heater according to yet another aspect of the present invention includes a sheet-like heat generating element, a sheet-like thermal sensing element, detecting means and current adjusting means. The sheet-like heat generating element includes carbon fiber mixed paper and electrodes provided on the carbon fiber mixed paper. The sheet-like thermal sensing element includes carbon fiber mixed paper and electrodes provided on the carbon fiber mixed paper and is laminated on the sheet-like heat generating element. The detecting means is connected to the electrodes of the sheet-like thermal sensing element to detect a change of a resistance value of the carbon fiber mixed paper of the sheet-like thermal sensing element. The current adjusting means is connected to the electrodes of the sheet-like heat generating element to adjust current to be supplied to the carbon fiber mixed paper of the sheet-like heat generating element on the basis of the change of the resistance value detected by the detecting means.

In this sheet-like heater, when the temperature of the sheet-like heat generating element changes, the resistance value of the carbon fiber mixed paper of the sheet-like thermal sensing element laminated thereon changes. By detecting the resistance value, the temperature of the sheet-like heat generating element is detected in a plane. The current to be supplied to the carbon fiber mixed paper of the sheet-like heat generating element is adjusted on the basis of the change of the detected resistance value.

Since the sheet-like thermal sensing element is formed of the carbon fiber mixed paper similarly to the sheet-like heat generating element, its thermal sensitiveness is excellent and the temperature change of the sheet-like heat generating element is equal to the thermal response of the sheet-like thermal sensing element. Accordingly, the temperature of the sheet-like heat generating element can be accurately controlled. Also, the sheet-like heat generating element and the sheet-like thermal sensing element can be simultaneously produced in the same manufacturing process, so that its production is easy. Furthermore, as the sheet-like heat generating element and the sheet-like thermal sensing element are formed of the carbon fiber mixed paper and integrally formed, it can be thin, light, and arbitrarily formed.

As described above, a thin and light sheet-like heater capable of accurately controlling the temperature of a sheet-like heat generating element can be obtained with good thermal heat responsiveness and arbitrary shape. Furthermore, its production is easy because the sheet-like heat generating element and the sheet-like thermal sensing element are manufactured in the same producing process.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
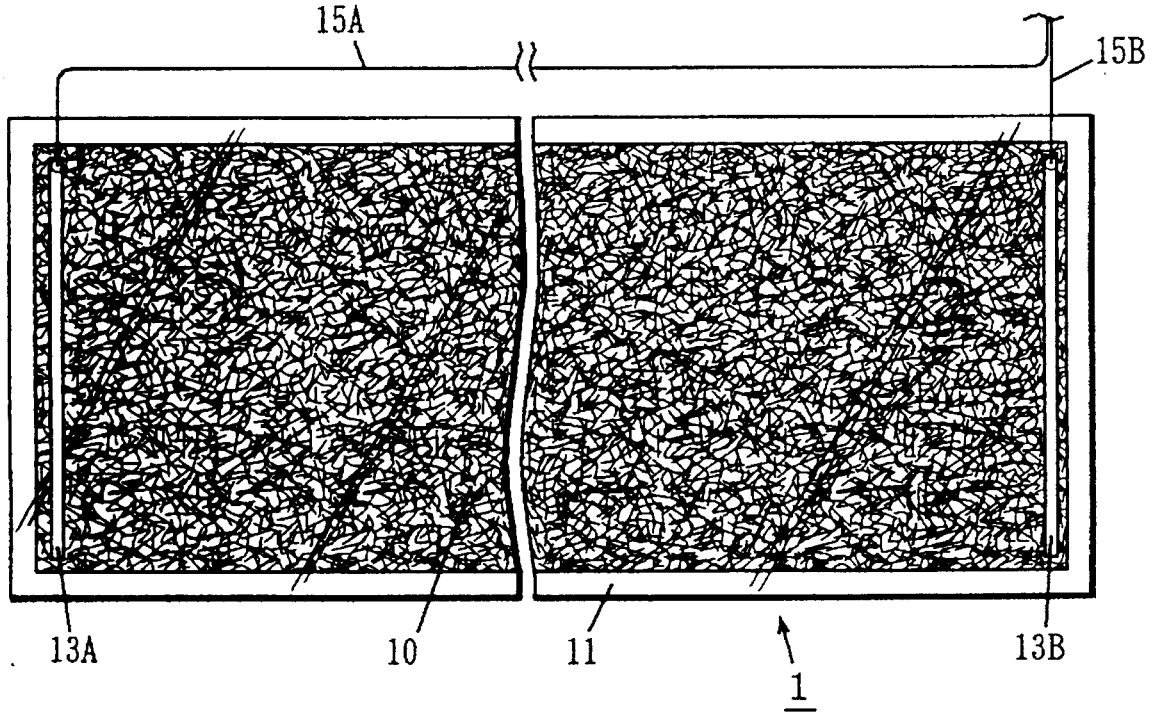
FIG. 1 is a plan view of a sheet-like thermal sensing element according to one embodiment of the present invention.
Figure 2:
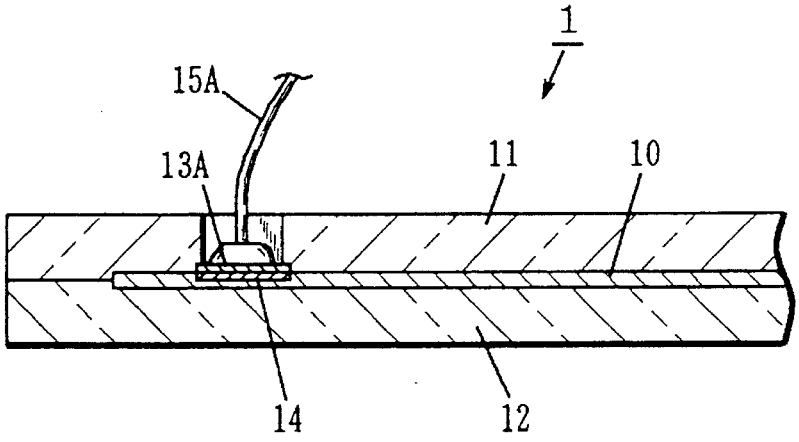
FIG. 2 is a section view of an end portion of the sheet-like thermal sensing element shown in FIG. 1.

FIG. 1 is a plan view of a sheet-like thermal sensing element according to one embodiment of the present invention, and FIG. 2 is a section view of the end portion of the sheet-like thermal sensing element.

This sheet-like thermal sensing element 1 includes carbon fiber mixed paper 10 and resin layers 11 and 12 laminated on both surfaces of the carbon fiber mixed paper. The resin layers 11 and 12 are made of the glass epoxy resin, for example. Other thermoplastic resins or thermosetting resins can also be used as the resin layers 11 and 12.

The carbon fiber mixed paper 10 is produced as described below. The pulp liquid is made by adding water to bast fiber such as the paper nulberry, the mitsumata (Edgeworthia papyrifera), or the ganpi (Wikstroemia sikokiana) which are used as materials of Japanese paper. Then, carbon fiber which is cut to about 5 mm is mixed therein and dispersed. The pulp liquid is flowed on a net for paper making to form a wet sheet. The wet sheet is mechanically dehydrated using a roll for water squeeze and dried, and then cut to predetermined dimensions. In this way, the carbon fiber mixed paper 10 of thickness about 0.2 mm is formed.

Next, one example of a method of manufacturing the sheet-like thermal sensing element 1 shown in FIG. 1 and FIG. 2 will be described. Silver paste 14 is printed in a band-like shape of width about 1 cm along opposite two sides of the carbon fiber mixed paper 10 and electrodes 13A and 13B made of copper foil tape is bonded on the silver paste 14 using an electrically conductive adhesive.

Furthermore, the carbon fiber mixed paper 10 is sandwiched between damp-dried glass-epoxy resin layers and hot-pressed to thermally harden the glass-epoxy resin layers. At this time, as shown in FIG. 2, holes for provision of wires are formed in the glass-epoxy resin layer in the areas at the end portions of the electrodes 13A and 13B. Thus, the resin layers 11 and 12 are laminated on both sides of the carbon fiber mixed paper 10. At last, wires 15A and 15B are connected to end portions of the electrodes 13A and 13B by means of soldering, for example. The sheet-like thermal sensing element 1 with thickness of about 0.5 mm is thus produced.

The resistance value of the carbon fiber mixed paper 10 changes depending on the temperature. Accordingly, the temperature of the sheet-like thermal sensing element 1 can be detected by detecting the resistance value of the carbon fiber mixed paper 10 through the electrodes 13A and 13B. As a result, the sheet-like thermal sensing element 1 can be used as a temperature sensor. As means for detecting the resistance value, a temperature detecting portion 31, a 0-point setting portion 32 and an amplifier 33 shown in FIGS. 5 and 6 which will be described later can be used, for example.

The sheet-like thermal sensing element 1 according to this embodiment is thin, light and has the flexibility, and can detect temperatures of surfaces of objects having various shapes. Furthermore, its thermal responsiveness is good since its mass is very small to enable precise temperature detection.

Accordingly, the sheet-like thermal sensing element 1 can be applied in wide variety of fields, which can be applied to various places and various apparatus which may be over heated. For example, if the sheet-like thermal sensing element 1 is applied to the fire alarm, temperatures in a large area can be sensed by a single element, so that extremely high safety is secured in preventing fires as compared with the conventional temperature sensors which can sense temperatures only in small areas.

Figures 3, 4:
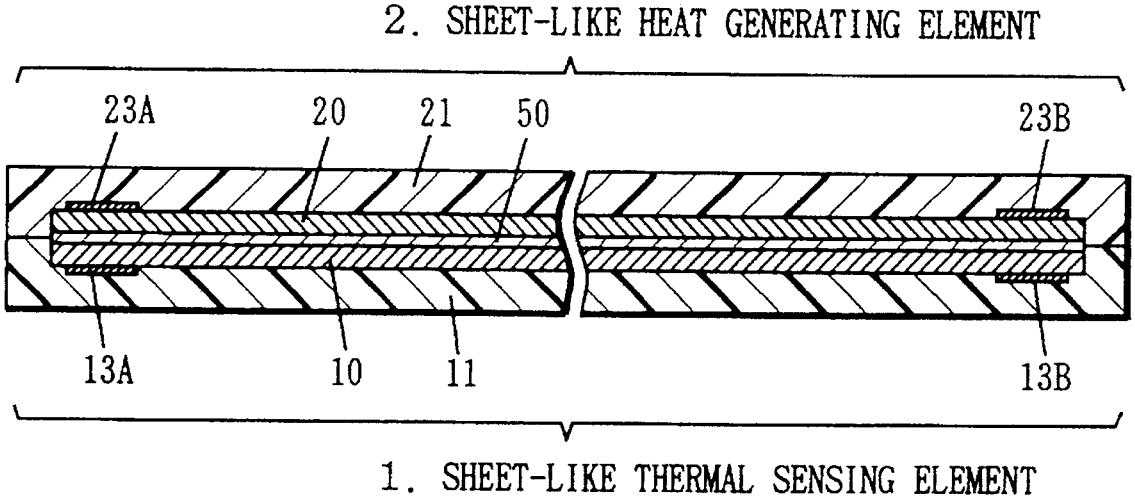
FIG. 3 is a section view of a sheet-like heater according to another embodiment of the present invention.
FIG. 4 is a diagram showing the change of the resistance value according to the temperature of the carbon fiber mixed paper.

FIG. 3 is a section view of a sheet-like heater according to another embodiment of the present invention.

The sheet-like heater shown in FIG. 3 includes carbon fiber mixed paper 10 and 20 laminated with insulating paper 50 interposed therebetween and resin layers 11 and 21 laminated on both sides of the carbon fiber mixed paper 10 and 20. Strip-shaped electrodes 13A and 13B are provided along two opposite sides on the surface of the carbon fiber mixed paper 10. Similarly, strip-shaped electrodes 23A and 23B are provided along opposite two sides on the surface of the carbon fiber mixed paper 20. In FIG. 3, wires connected to these electrodes 13A, 13B, 23A and 23B are not shown.

The carbon fiber mixed paper 10, the resin layer 11 and the electrodes 13A and 13B constitute the sheet-like thermal sensing element 1. The carbon fiber mixed paper 20, the resin layer 21 and the electrodes 23A and 23B constitute the sheet-like heat generating element 2. The sheet-like thermal sensing element 1 and the sheet-like heat generating element 2 are thus integrally formed.

The carbon fiber mixed paper 10 and 20 can be simultaneously produced in the same producing process. The carbon fiber mixed paper 20 for the sheet-like heat generating element 2 must have heat generating characteristics which satisfy certain standards, so that the carbon fiber mixed paper which is out of the standards in production can not be used for the sheet-like heat generating elements. On the other hand, the carbon fiber mixed paper for the sheet-like thermal sensing element 1 is not required to satisfy specific standards if the change of its resistance value in accordance with the temperature is measured. Accordingly, the carbon fiber mixed paper out of the standards in the manufacturing process of the sheet-like heat generating element 2 can be used as the carbon fiber mixed paper for the sheet-like thermal sensing element 1. As a result, the production yield is improved.

As described above, the production is easy because the sheet-like thermal sensing element 1 and the sheet-like heat generating element 2 can be simultaneously produced in the same producing process. Furthermore, the sheet-like thermal sensing element 1 and the sheet-like heat generating element 2 are made of carbon fiber mixed paper 10 and 20, respectively, and they are integrally formed, therefore it is thin and light, and it can be arbitrarily shaped.

One example of the change of the resistance value according to the temperature of the carbon fiber mixed paper is shown in FIG. 4. In this example, the resistance value changes by 5 Ω owing to a temperature change from 30° C. to 102° C. Accordingly, the temperature change can be detected by converting the change in the resistance value into a change of voltage.

For instance, a resistor of 10 KΩ is connected in series to the carbon fiber mixed paper 10 and a voltage of 10 V is applied to both ends of the series circuit. When the temperature of the sheet-like thermal sensing element 1 is 30° C., the voltage appearing at both ends of the carbon fiber mixed paper 10 is given as $$10\times(67.9/10067.9)=0.067442\ [V] \quad (1)$$

When the temperature of the sheet-like thermal sensing element 1 is 102° C., the voltage appearing at both ends of the carbon fiber mixed paper 10 is given as $$10\times(62.9/10062.9)=0.062506\ [V] \quad (2)$$

Accordingly, the change in voltage corresponding to the temperature change from 30° C. to 102° C. can be expressed as follows.

$$0.067442-0.062506=0.004936\ [V] \quad (3)$$

Thus, the voltage change of 0.004936 V appears corresponding to the temperature change of 72 degrees. If the voltage change is amplified by 1000 times, it is about 5 V. By adjusting the voltage at the temperature 30° C. to 0 V using a pre-set variable resistor, the temperature change from 30° C. to 102° C. can be converted into the voltage change from 0 V to 5 V. The temperature can be detected by the sheet-like thermal sensing element 1 as described above.

Figure 5:
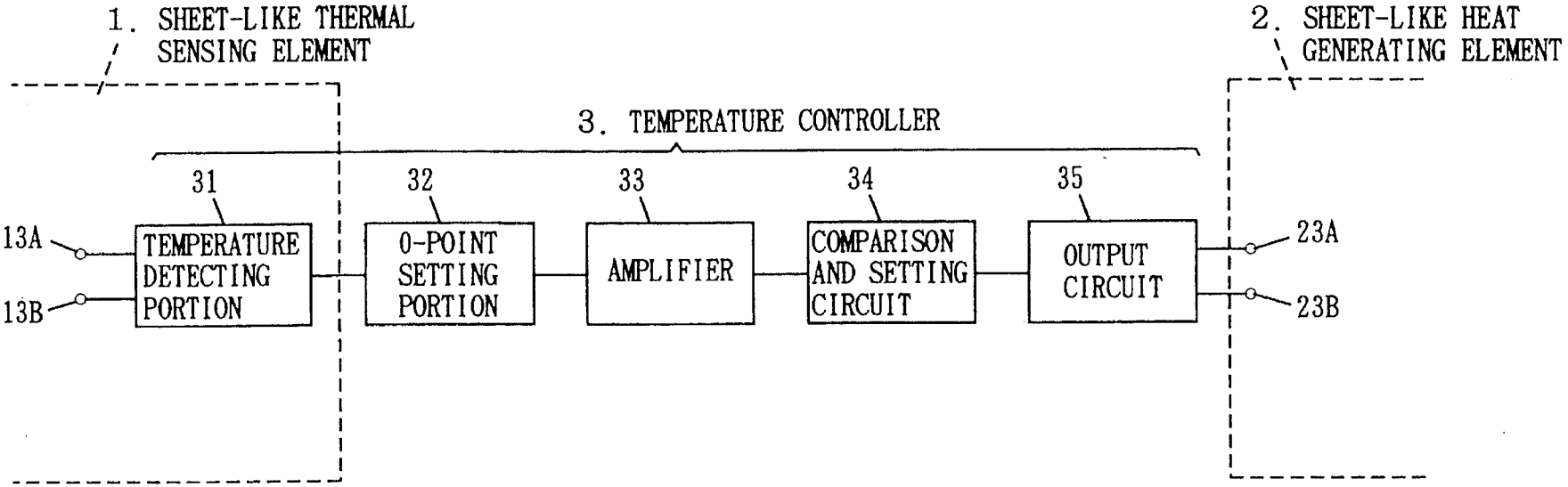
FIG. 5 is a functional block diagram illustrating the structure of a temperature controller connected to the sheet-like heater shown in FIG. 3.

FIG. 5 is a functional block diagram showing the structure of a temperature controller connected to the sheet-like heater shown in FIG. 3. The temperature controller 3 shown in FIG. 5 includes a temperature detecting portion 31, a 0-point setting portion 32, an amplifier 33, a comparison and setting circuit 34 and an output circuit 35.

The temperature detecting portion 31 is connected to the electrodes 13A and 13B of the sheet-like thermal sensing element 1 to detect the temperature of the sheet-like thermal sensing element 1 by converting the change of the resistance value of the carbon fiber mixed paper 10 (refer to FIG. 3) into the change of voltage. The 0point setting portion 32 sets an output voltage at a low temperature as a reference to 0 V. In this embodiment, the 0-point is set by a pre-set variable resistor so that the output voltage is 0 V when the outside air temperature is 30° C.

The amplifier 33 amplifies the output voltage of the temperature detecting portion 31 to 1000 times.

The comparison and setting circuit 34 performs temperature setting of the sheet-like heat generating element 2 with a variable resistor and compares the temperature detected by the sheet-like thermal sensing element 1 with the set temperature of the sheet-like heat generating element 2 to generate a voltage on the basis of the temperature difference. The output portion 35 turns on and off the current to the sheet-like heat generating element 2 through the electrodes 23A and 23B on the basis of the output voltage of the comparison and setting circuit 34 to control the temperature of the sheet-like heat generating element 2.

Figure 6:
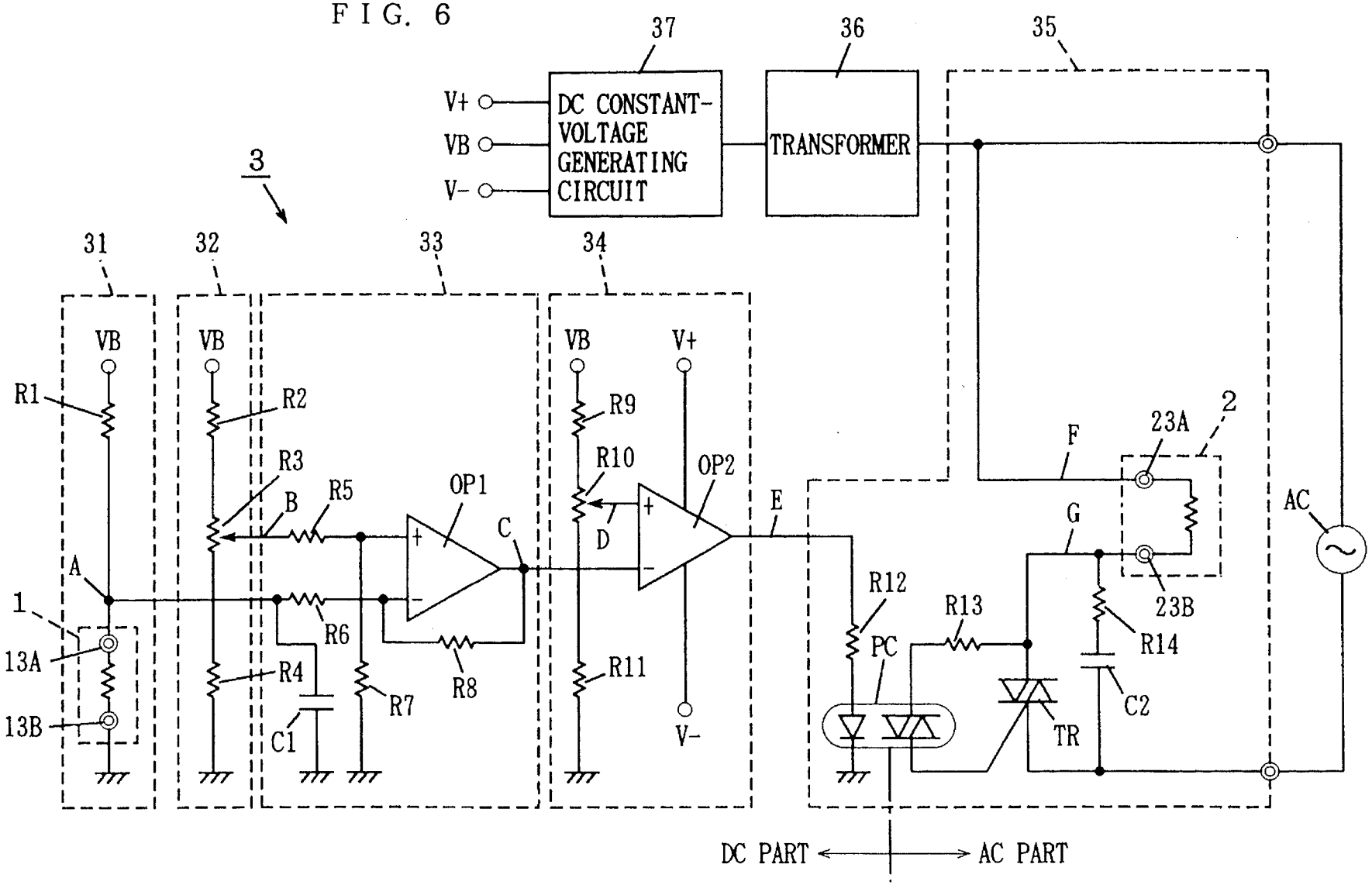
FIG. 6 is a detailed circuit diagram of the temperature controller shown in FIG. 5.
Figure 7:
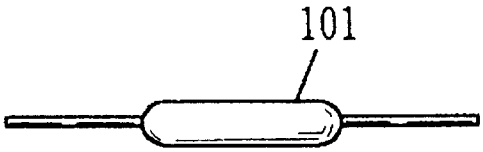
FIG. 7 PRIOR ART
FIG. 7 is a diagram showing a conventional thermistor.
Figure 8:
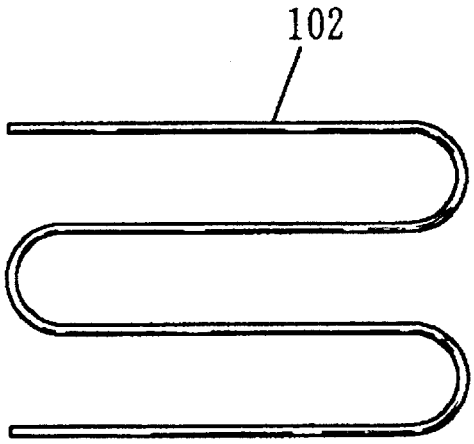
FIG. 8 PRIOR ART
FIG. 8 is a diagram showing a conventional thermal sensing wire.
Figure 9:
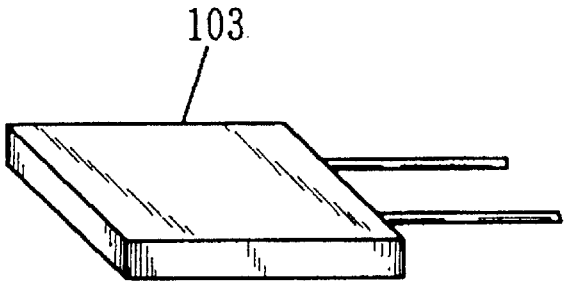
FIG. 9 PRIOR ART
FIG. 9 is a diagram showing a conventional thermostat.

FIG. 6 is a circuit diagram showing the detailed structure of the temperature controller 3 shown in FIG. 5. In FIG. 6, the AC voltage supplied from an AC power supply is decreased to a predetermined low AC voltage by a transformer 36. A predetermined positive DC voltage V+, a predetermined negative DC voltage V− and a DC voltage VB of 10 V are generated from the low AC voltage by a DC constant-voltage generating circuit 37.

The temperature detecting portion 31 includes a resistor R1. The resistor R1 is connected to the carbon fiber mixed paper 10 of the sheet-like thermal sensing element 1 in series. The DC voltage VB of 10 V is applied to both ends of the series circuit. In this embodiment, the resistor R1 has a resistance value of 10 KΩ. The carbon fiber mixed paper 10 of the sheet-like thermal sensing element 1 has a resistance value which varies in the range of 67.9Ω to 62.9Ω at temperatures ranging from 30° C. to 102° C. as shown in FIG. 4.

Accordingly, when the temperature of the sheet-like thermal sensing element 1 is 30° C., the voltage of 0.06742 V appears at a node A as indicated by the expression (1). When the temperature of the sheet-like thermal sensing element 1 is 102° C., as indicated by the expression (2), the voltage of 0.062506 V appears at the node A. That is to say, the range of temperature change of 72 degrees corresponds to the range of voltage change of 0.004936 V.

The 0-point setting portion 32 includes a resistor R2, a pre-set variable resistor R3 and a resistor R4. The resistor R2, the pre-set variable resistor R3 and the resistor R4 are connected in series, and the DC voltage VB of 10 V is applied to both ends of the series circuit. The voltage appearing at a node B can be adjusted by adjusting the pre-set variable resistor R3.

The amplifier 33 includes an operational amplifier OP1, resistors R5, R6, R7 and R8, and a capacitor C1. The operational amplifier OP1 and the resistors R5–R8 constitute a differential amplifier circuit. This differential amplifier circuit amplifies a voltage difference between the node A and the node B to 1000 times and applies the output voltage to a node C. The range of voltage change of 0.004936 V which corresponds to the range of temperature change of 72 degrees can thus be amplified to the range of voltage change of about 5 V. By adjusting the pre-set variable resistor R3 in the 0-point setting portion 30 so that the voltage at the node B is equal to the voltage at the node A at 30° C., the output voltage at the node C at 30° becomes 0 V. That is to say, the temperature change of 30° C.–102° C. can be converted into the voltage change of 0 V–5 V. The comparison and setting circuit 34 includes an operational amplifier OP2, a resistor R9, a variable resistor R10 and a resistor R11. The resistor R9, the variable resistor R10 and the resistor R11 are connected in series, and the DC voltage VB of 10 V is applied to both ends of the series circuit. By adjusting the variable resistor R10, the reference voltage appearing at a node D can be adjusted in a range of 0 V to 5 V. The operational amplifier OP operates as a comparator to compare the output voltage C at the node C with the reference voltage at the node D. When the output voltage at the node C is higher than the reference voltage at the node D, a positive output voltage appears at the node E.

The output portion 35 includes resistors R12, R13, R14, a capacitor C2 a photocoupler PC and a triac TR. When the positive output voltage appears at the node E, current flows to the resistor R12 and the light emitting portion of the photocoupler PC. Accordingly, the light emitting portion of the photocoupler PC emits light, and the current flows to the light receiving portion of the photocoupler PC and the resistor R13. The triac TR thus turns on. As a result, the AC voltage supplied from the AC voltage supply AC is applied between the node F and the node G. Thus, the current is supplied to the carbon fiber mixed paper 20 (refer to FIG. 3) of the sheet-like heat generating element 2 through the electrodes 23A and 23B to increase the temperature of the sheet-like heat generating element 2.

On the other hand, if the positive output voltage does not appear at the node E, the current does not flow to the light emitting portion of the photocoupler PC and the current does not flow to the light receiving portion of the photocoupler PC, either. Accordingly, the triac TR turns off to cut off the AC power supply AC and the sheet-like heat generating element 2. Thus, the current is not supplied to the carbon fiber mixed paper 20 of the sheet-like heat generating element 2 to decrease the temperature of the sheet-like heat generating element 2. As described above, the sheet-like heat generating element 2 is controlled to the set temperature by the variable resistor R10 in the comparison and setting circuit 34.

The temperature rising rate of the sheet-like heat generating element 2 is very fast since it is made of the carbon fiber mixed paper 20. The thermal responsiveness of the sheet-like thermal sensing element 1 is very good since it is made of the carbon fiber mixed paper 10 as the sheet-like heat generating element 2, and the temperature change of the sheet-like heat generating element 2 and the thermal response of the sheet-like thermal sensing element 1 are equal to each other. Accordingly, the temperature of the sheet-like heat generating element 2 can be detected and controlled with high accuracy.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet-like thermal sensing element, comprising:

carbon fiber mixed paper; and electrodes provided on said carbon fiber mixed paper wherein an electrical resistance of said carbon fiber mixed paper of a specific mass varies about 5 ohms over a temperature range of about 72° C.

2. The sheet-like thermal sensing element according to claim 1, wherein said carbon fiber mixed paper consists of carbon fiber of predetermined dimension dispersed in a pulp.

3. The sheet-like thermal sensing element according to claim 2, wherein said pulp includes natural pulp including bast fiber.

4. The sheet-like thermal sensing element according to claim 1, further comprising a resin layer laminated on said carbon fiber mixed paper.

5. The sheet-like thermal sensing element according to claim 1, wherein said electrodes include electrically conductive tapes bonded with an electrically conductive adhesive on said carbon fiber mixed paper.

6. A temperature sensor, comprising:

a sheet-like thermal sensing element including carbon fiber mixed paper wherein an electrical resistance of said carbon fiber mixed paper of a specific mass varies about 5 ohms over a temperature range of about 72° C., electrodes provided on said carbon fiber mixed paper and resin forming said carbon fiber mixed paper into a sheet-like shape; and detecting means connected to said electrodes for detecting a resistance value of said carbon fiber mixed paper.

7. The temperature sensor according to claim 6, wherein said carbon fiber mixed paper consists of carbon fiber of predetermined dimension dispersed in a pulp.

8. The temperature sensor according to claim 6, wherein said detecting means includes means for supplying current to said carbon fiber mixed paper and means for converting the current flowing to said carbon fiber mixed paper into a voltage.

9. A temperature controller for a heat generating element, comprising:

a sheet-like thermal sensing element including carbon fiber mixed paper and electrodes provided on said carbon fiber mixed paper wherein an electrical resistance of said carbon fiber mixed paper of a specific mass varies about 5 ohms over a temperature range of about 72° C.;

detecting means connected to said electrodes of said sheet-like thermal sensing element for detecting a change of a resistance value of said carbon fiber mixed paper; and current adjusting means for adjusting current to be supplied to said heat generating element on the basis of the change of the resistance value detected by said detecting means.

10. The temperature controller according to claim 9, wherein said carbon fiber mixed paper consists of carbon fiber of predetermined dimension dispersed in a pulp.

11. The temperature controller according to claim 9, further comprising a resin layer laminated on said carbon fiber mixed paper.

12. The temperature controller according to claim 9, wherein said detecting means includes means for supplying current to said carbon fiber mixed paper and means for converting the current flowing to said carbon fiber mixed paper into a voltage, and said current adjusting means includes means for comparing the voltage converted by said converting means with a predetermined reference voltage and means for supplying current to said heat generating element on the basis of a result of comparison by said comparing means.

13. A sheet-like heater, comprising:

a sheet-like heat generating element including carbon fiber mixed paper and electrodes provided on said carbon fiber mixed paper; and a sheet-like thermal sensing element including carbon fiber mixed paper and electrodes provided on said carbon fiber mixed paper, said sheet-like thermal sensing element laminated on said sheet-like heat generating element wherein an electrical resistance of said carbon fiber mixed paper of a specific mass varies about 5 ohms over a temperature range of about 72° C.

14. The sheet-like heater according to claim 13, wherein each of said carbon fiber mixed paper of said sheet-like heat generating element and said carbon fiber mixed paper of said sheet-like thermal sensing element consists of carbon fiber of predetermined dimension dispersed in a pulp.

15. The sheet-like heater according to claim 13, wherein said carbon fiber mixed paper of said sheet-like heat generating element and said carbon fiber mixed paper of said sheet-like thermal sensing element are laminated through insulating paper, and further comprising a resin layer for forming said sheet-like heat generating element, said insulating paper and said sheet-like thermal sensing element into a sheet-like shape.

16. A sheet-like heater, comprising:

a sheet-like heat generating element including carbon fiber mixed paper and electrodes provided on said carbon fiber mixed paper;

a sheet-like thermal sensing element including carbon fiber mixed paper and electrodes provided on said carbon fiber mixed paper and is laminated on said sheet-like heat generating element wherein an electrical resistance of said carbon fiber mixed paper of a specific mass varies about 5 ohms over a temperature range of about 72° C.;

detecting means connected to said electrodes of said sheet-like thermal sensing element for detecting a change of a resistance value of said carbon fiber mixed paper of said sheet-like thermal sensing element; and current adjusting means connected to said sheet-like heat generating element for adjusting current to be supplied to said carbon fiber mixed paper of said sheet-like heat generating element on the basis of the change of the resistance value detected by said detecting means.

17. The sheet-like heater according to claim 16, wherein said carbon fiber mixed paper consists of carbon fiber of predetermined dimension dispersed in a pulp.

18. The sheet-like heater according to claim 16, wherein each of said carbon fiber mixed paper of said sheet-like heat generating element and said carbon fiber mixed paper of said sheet-like thermal sensing element are laminated through insulating paper, and further comprising a resin layer for forming said sheet-like heat generating element, said insulating paper and said sheet-like thermal sensing element into a sheet-like shape.

19. A method of producing a sheet-like thermal sensing element, comprising steps of:

producing carbon fiber mixed paper by mixing carbon fiber which is cut with a predetermined dimension into natural pulp including bast fiber wherein an electrical resistance of said carbon fiber mixed paper of a specific mass varies about 5 ohms over a temperature range of about 72° C.;

forming electrodes on said carbon fiber mixed paper; and forming said carbon fiber mixed paper with a resin layer.

20. A method of producing a sheet-like heater, comprising the steps of:

producing carbon fiber mixed paper for a sheet like-heat generating element and carbon fiber mixed paper for a sheet-like thermal sensing element by mixing carbon fiber cut in a predetermined dimension into natural pulp including bast fiber wherein an electrical resistance of said carbon fiber mixed paper of a specific mass varies about 5 ohms over a temperature range of about 72° C.;

forming electrodes on said carbon fiber mixed paper for said sheet-like heat generating element and said carbon fiber mixed paper for said sheet-like thermal sensing element, respectively;

laminating said carbon fiber mixed paper for said sheet-like heat generating element and said carbon fiber mixed paper for said sheet-like thermal sensing element through insulating paper; and forming said laminated carbon fiber mixed paper with a resin layer.

* * * * *